United States Patent [19]

DuFour

[11] Patent Number: 5,024,007

[45] Date of Patent: Jun. 18, 1991

[54] SOLE FOR A SPORT SHOE

[75] Inventor: Pierre DuFour, Menthon-St-Bernard, France

[73] Assignee: Salomon S. A., Chavanod, France

[21] Appl. No.: 514,435

[22] Filed: Apr. 25, 1990

[30] Foreign Application Priority Data

Apr. 25, 1989 [FR] France ..... 89 05475

[51] Int. Cl.[5] ..... A43B 3/00; A43B 13/14

[52] U.S. Cl. ..... 36/127; 36/25 R; 36/31; 36/114

[58] Field of Search ..... 36/31, 30 R, 25 R, 127, 36/114, 67 D, 59 C, 102, 103, 28, 30 A

[56] References Cited

U.S. PATENT DOCUMENTS

| | | | |
|---|---|---|---|
| 2,897,611 | 8/1959 | Schaller | 36/30 R |
| 3,487,563 | 1/1970 | Austin | 36/67 D |
| 4,546,559 | 10/1985 | Dassler | 36/31 |
| 4,624,062 | 11/1986 | Autry | 36/114 |
| 4,754,561 | 7/1988 | DuFour | 36/31 |
| 4,837,949 | 6/1989 | DuFour | 36/127 |
| 4,866,861 | 9/1989 | Noone | 36/127 |
| 4,885,851 | 12/1989 | Peterson | 36/127 |
| 4,922,631 | 5/1990 | Anderie | 36/114 |

FOREIGN PATENT DOCUMENTS

| | | | |
|---|---|---|---|
| 0115663 | 8/1984 | European Pat. Off. | 36/114 |
| 953518 | 12/1949 | France | 36/31 |

*Primary Examiner*—Steven N. Meyers

*Attorney, Agent, or Firm*—Pollock, Vande Sande & Priddy

[57] ABSTRACT

A walking sole for a sport shoe, and especially a golf shoe, comprising a main element made of a relatively rigid molded plastic material, having, in the front portion of at least one of its lateral edges (1*a*) extending along the front area of the sole on which the front part of the wearer's foot gains support, a succession of notches (2). This shoe has, associated with at least one of these notches (2), at least one opening (6) elongated substantially transversely and in alignment with this notch (2) in the lateral edge (1*a*) and at a distance from it, and an element made of an elastic material (8) which fills the elongated opening (6).

19 Claims, 2 Drawing Sheets

SOLE FOR A SPORT SHOE

FIELD OF THE INVENTION

The present invention relates to a walking sole for a sport shoe in particular a golf shoe, and to a shoe fitted with this sole.

BACKGROUND OF THE INVENTION

Shoe soles are already known in which the edges have notches transverse to the longitudinal axis of the shoe, so as to facilitate a relative torsion of the front part of the sole in relation to its rear part. For example, French Patent FR-A-2 553 636 discloses a shoe whose intermediate sole has, along the front portion of its outer edge, notches which house elements made of a material whose hardness exceeds that of the material constituting the intermediate sole layer. This latter arrangement attempts to improve the flexibility and shock-absorption properties obtained in the direction of the stride during walking, running, or jumping. Furthermore, Patent Application FR-A-2 608 387 filed by the Applicant discloses a walking sole for a sport shoe which incorporates notches in the front portion of at least one of the lateral edges of the sole extending along the front area of the sole on which the front part of the wearer's foot gains its support, and these notches, which are filled with a material whose degree of elasticity exceeds that of the material composing the sole itself, delimit transversely flexible tongues.

SUMMARY OF THE INVENTION

The present invention relates to improvements made in such a walking sole in order to give it both greater longitudinal flexibility and a degree of transverse rigidity extending beyond the notches toward the central part of the sole.

For this purpose, this walking sole for sport shoes, especially for golf shoes, comprising a principal part made of a relatively stiff, molded plastic material and which has, in the front portion of at least one of its lateral edges extending along the front area of the sole on which the front part of the wearer's foot gains support, a succession of substantially transverse spaced notches opening into the edge of the sole and extending toward the central part of the latter, these notches being filled with a material whose degree of elasticity exceeds that of the material composing the main part of the sole, and which forms individual elastic filling elements lodged in the respective grooves, these grooves delimiting at least one tongue which is transversely flexible around a line located in proximity to the inner ends of the notches, is characterized by the fact that this sole has at least one elongated opening associated with at least one of its notches, this opening being aligned with this notch in the lateral edge and at a distance from it, and an element made of an elastic material which fills the elongated opening.

According to a complementary characteristic of the invention, each of the flexible tongues carries at least one stud designed to embed in the ground, this stud being permanently attached to the sole during molding, or, after molding of the sole, set firmly in a gripping piece formed on the flexible tongue during molding.

Another object of the invention is a sport shoe, especially a golf shoe, fitted with a walking sole such as the one described above.

BRIEF DESCRIPTION OF THE DRAWINGS

Various embodiments of the present invention will be described below as examples, with reference to the drawings in which.

DESCRIPTION OF THE PREFERRED EMBODIMENT

Figure 1:
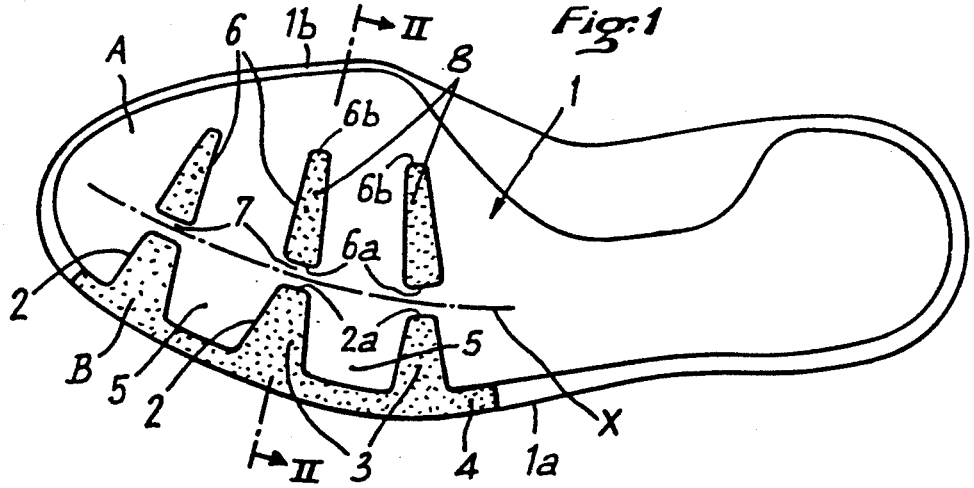
FIG. 1 is a view from below of a walking sole for a sport shoe, when the elements filling the lateral notches are connected by means of a border made of an elastic material.

The walking sole according to the invention, designated in its entirety as 1 in FIG. 1, comprises a front part which is adapted to exhibit a degree of longitudinal flexibility at the spot where the front part of the wearer's foot gains support, while still retaining a degree of transverse stiffness. Accordingly, the walking sole 1 has, in its front part and at least along its outer lateral edge 1*a*, a combination of two materials having different degrees of elasticity. More especially, the walking sole 1 comprises two parts A and B made of plastic materials possessing different degrees of elasticity. The largest portion A of the walking sole 1 is molded in a relatively stiff plastic material and has, along the front portion of its outer lateral edge 1*a* duplicate-molded part B made of a plastic material which is basically elastic and which has a degree of elasticity clearly greater than the plastic material composing the main part A of the sole. The relatively elastic plastic material of the duplicate-molded layer B fills a succession of spaced notches 2 formed during the molding of the main part A of the sole. These notches open out into the outer lateral edge 1*a* of this part A, and extend substantially transversely toward the medial longitudinal plane of the sole. These notches 2 may be delimited by parallel surfaces, or they may converge as they extend toward the median longitudinal plane, so as to embody a substantially trapezoidal shape with a large outer base situated in the plane of the outer edge 1*a*, and with a small inner base 2*a* constituting the inner end of the notch 2. Individual elastic filling elements 3 are thus formed in the notches, and may be joined together along the outer lateral edge 1a of the sole, as shown in FIG. 1, by a border 4 which is duplicated molded simultaneously with the individual filling elements 3. In other words, in the non-limiting embodiment illustrated in FIG. 1, the duplicate molded part B, made of an elastic material, is formed, first, from the continuous border 4, which, in fact, makes up a portion of the outer lateral edge 1a of the walking sole 1, and second, from the individual elastic filling elements 3 which create teeth-like elements tightly inserted in the grooves 2 of part A made of a substantially rigid plastic material.

The notches 2 in part A of the walking sole delimit tongues 5 which belong to the main molded part A made of a relatively rigid material, and which are flexible transversely around a line of flexion X extending in proximity to the inner ends 2a of the notches 2.

In accordance with the invention, the main sole component A made of a relatively rigid material has elongated openings 6 which form extensions of all or some of the notches 2. In the embodiment illustrated in FIG. 1, each notch 2 has an associated opening 6 at a distance from the notch 2, while being separated from it by means of a bridge 7 made of the relatively rigid material A composing the main part of the sole. The openings may be of any shape whatever, but are, in particular, trapezoidal, thereby substantially extending the trapezoidal shape of the notches 2. In other words, each bridge 7 made of the relatively rigid material A extends between the small base 2a forming the inner end of a notch 2 and the large base 6a of a trapezoidal opening 6 whose small base 6b is oriented toward the inner lateral edge 1b of the sole 1, the convergent sides of the opening 6 being substantially aligned with the convergent sides of the notch 2.

Figure 2:
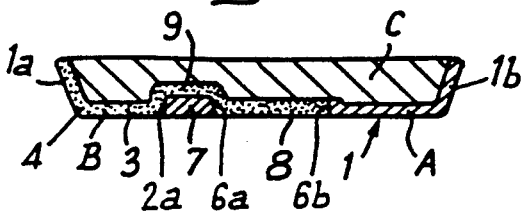
FIG. 2 is a vertical cross-section along line II—II in FIG. 1.

Each opening 6 is filled with the duplicate molded elastic plastic material so as to contain one elastic filling element 8, and this elastic material may be identical to material B or to a different material. As can be seen in FIG. 2, the outer 3 and inner 8 filling elements are formed from the same elastic material B, and are connected by a piece 9 made of the duplicate molded plastic material B which forms an "arch" above the bridge 7 of material A. The entire sole formed from plastic materials A and B may be covered with a layer of a filling material C, as illustrated in FIG. 2, this material C extending between the outer lateral edge 1a made of relatively elastic material B, and the inner lateral edge 1b, made of relatively rigid material A, of the sole. Material C has elastic properties different from those of plastic materials A and B, and does not determine the flexible behavior of the sole, which is determined predominately by the nature of plastic materials A and B.

Figure 3:
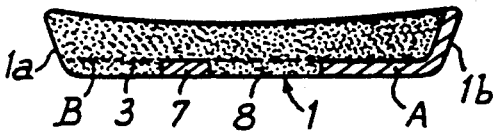
FIGS. 3 and 4 are vertical cross-sections similar to that in FIG. 2, but illustrating variants of the sole.

In the variant illustrated in FIG. 3, the layer of elastic plastic material B has a thickness greater than that in the embodiment illustrated in FIG. 2. This layer extends over the entire width and thickness of the complete sole 1, between its outer lateral edge 1a and the inner lateral edge 1b made of the rigid material A, acting as the filling material C layer.

Figure 4:
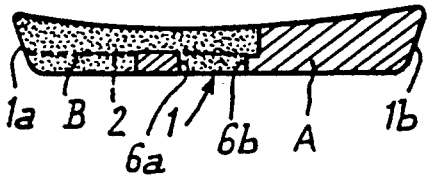

In the embodiment illustrated in FIG. 4, the layer of the elastic plastic material B, whose thickness is equal to that of the entire sole, extends transversely only in part, for practical purposes above the notches 2, the bridges 7, and the openings 6. Beginning at the inner ends 6b of the openings 6, the thickness of the complete sole is composed totally of the relative rigid plastic material A.

Figure 5:
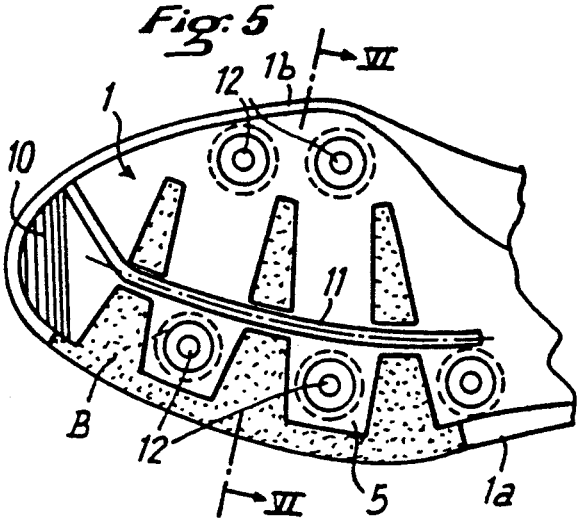
FIG. 5 is a diagrammatic view from below of a variation of the front part of a walking sole according to the invention.
Figure 6:
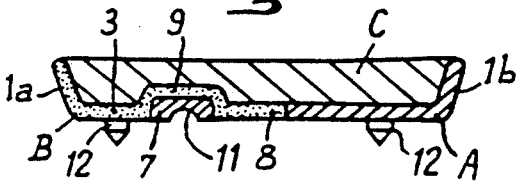
FIG. 6 is a vertical cross-section along line VI—VI of FIG. 5.
Figure 7:
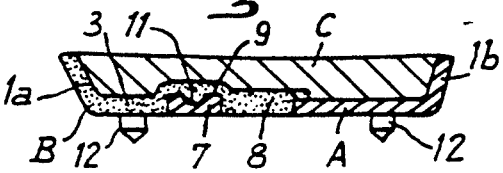
FIG. 7 is a vertical cross-section analogous to that in FIG. 6 and illustrating a variant.

FIGS. 5 and 6 illustrate a variant of the sole comprising a front walking tip 10 and a flexion groove 11 between the outer notches 2 and the inner openings 6. The flexion groove 11, which is substantially parallel to the outer lateral edge 1a, is cut in the lower surface of the element made of the relative rigid plastic material A, and, in particular, in the bridges 7. It opens downward, as can be seen in FIG. 6. In the variant shown in FIG. 7, the flexion groove 11 is, on the other hand, cut in the upper surface of the bridges 7, and opens upward. FIGS. 4, 5, and 6 also show that the sole 1 carries studs 12 fastened to the flexible tongues 5 and along the inner edge 1b of the front part of the sole.

Figure 8:
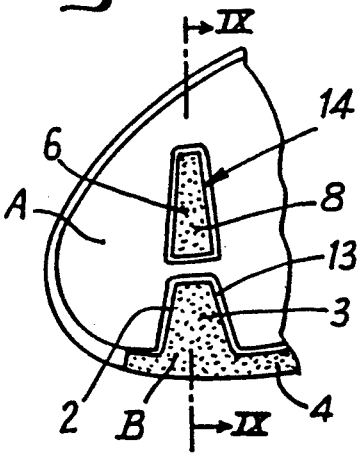
FIG. 8 is a partial diagrammatic view from below of another variant of the front part of a walking sole according to the invention.
Figure 9:
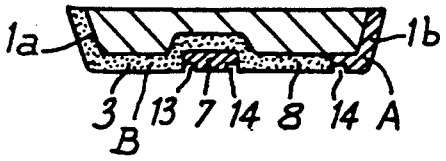
FIG. 9 is a vertical cross-section along line IX—IX in FIG. 8.
Figure 10:
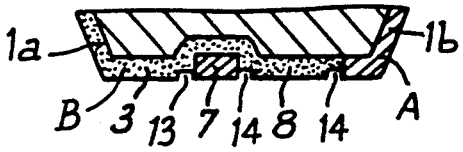
FIG. 10 is a vertical cross-section analogous to that in FIG. 9 and illustrating a variant.

FIGS. 8, 9, and 10 illustrate variants in which junction lines are provided on the perimeter of the notches 2 and openings 6. In FIG. 9, the junction lines 13 and 14, which surround the filling elements 13 and 14, respectively, lodged in the notches 2 and openings 6, are recessed in the relatively rigid plastic material A composing the main element of the sole. On the other hand, in the variant illustrated in FIG. 10, these junction lines 13, 14 are recessed along the perimeter of the filling elements 3, 8 lodged in the notches 2, 6, respectively.

Figure 11:
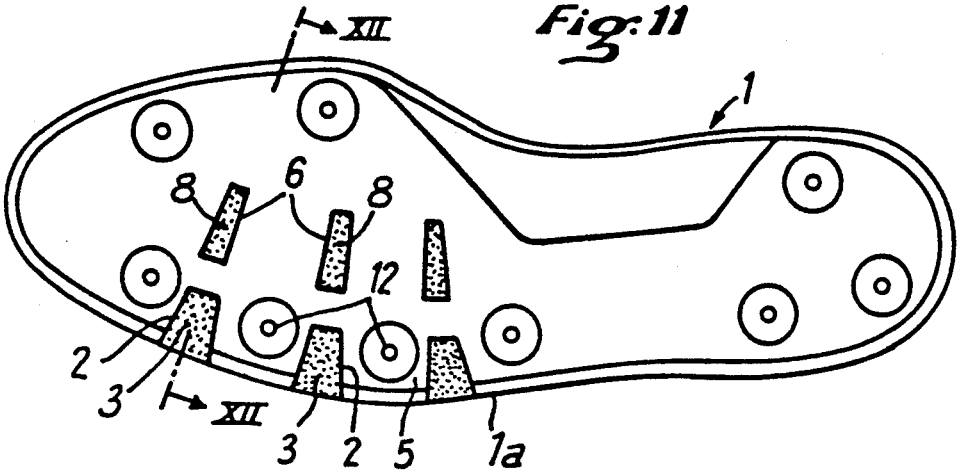
FIG. 11 is a view from below of another variant of a walking sole according to the invention.
Figure 12:
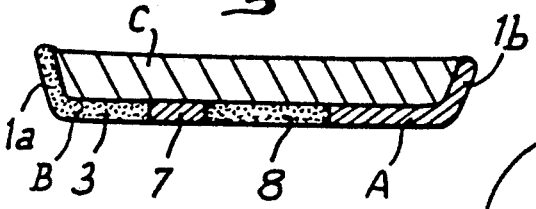
FIG. 12 is a vertical cross-section along line XII—XII in FIG. 11.

FIG. 11 represents an invention variant in which the filling elements 3 formed in the lateral notches 2, are not connected by a border 4, as is the case in the embodiment illustrated in FIG. 1. In other words, the elastic filling elements 3 housed in the respective lateral notches 2, are independent one from the other. The filling elements 8 made of the elastic material, inserted in the openings 6, may be connected to the filling elements 3 inserted in the notches 2, as has been described in the preceding examples. In accordance with a variant, these filling elements 8 may be totally separated from the filling elements, as is shown in FIG. 12, and they may, in that case, be made of a material different from the one used to form the filling elements 3.

Figure 13:
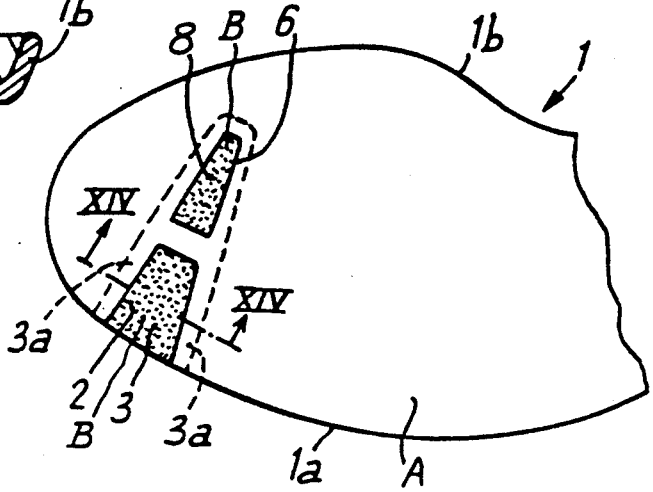
FIG. 13 is a view from below of another embodiment of the sole.
Figure 14:
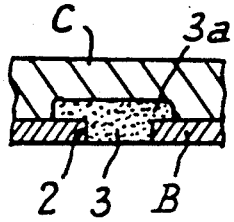
FIG. 14 is a vertical cross section along line XIV—XIV in FIG. 13.

In the variant illustrated in FIGS. 13 and 14, the relative elastic plastic material B, which forms the filling elements 3 and 8, covers at least partially the edges of the notches 2 and openings 6. In other words, the filling elements 3, 8 have upper sections, located above the notches 2 and the openings 6 respectively, that are wider than their lower sections, tightly pressed into the notches 2 and the openings 6, thereby forming lateral projecting pieces 3a, as is illustrated in FIG. 14 for a filling element 3 lodged in a notch 2.

What is claimed is:

1. Walking sole for a sport shoe, especially a golf shoe, comprising a principal element made of a relatively stiff, molded plastic material and which has, in the front portion of at least one of its lateral edges (1a) extending along the front area of the sole on which the front part of the wearer's foot gains support, a succession of substantially transverse spaced notches (2) which open into the edge (1a) of the sole, and extend toward the central part of the latter, these notches (2) being filled with a material (B) whose degree of elasticity exceeds that of the material (A) composing the main part of the sole, and which forms individual elastic filling elements (3) lodged in the respective notches (2) delimiting between each pair at least one tongue (5) which is transversely flexible around a line (X) located in proximity to the inner ends (2a) of the notches (2), wherein said sole has at least one opening elongated substantially transversely (6) associated with at least one of its notches (2), this opening being aligned with this notch (2) in the lateral edge (1a) and at a distance from it, and an element made of an elastic material (8) which fills the elongated opening (6).

2. Walking sole according to claim 1, wherein said lateral notch (2) is separated from said opening (6) aligned with it by a bridge (7) made of said relatively rigid material (A) constituting the main element of said sole.

3. Walking sole according to claim 2, wherein each notch (2) is substantially trapezoidal in shape, with a long outer base located in the plane of the outer edge (1*a*) of the sole and with a short inner base (2*a*) constituting the inner end of said notch (2), and wherein each opening (6) is substantially trapezoidal in shape, extending the trapezoidal shape of said notch (2), said short base (2*a*) constituting the inner end of a notch (2) being separated, by means of said bridge (7) of the relatively rigid material (A), from said long base (6*a*) of a trapezoidal opening (6) whose short base (6*b*) is oriented toward the said inner edge (1*b*) of said sole (1), the convergent sides of said opening (6) being substantially in alignment with the convergent side of said groove (2).

4. Walking sole according to claim 2 or 3, comprising a flexion groove (11) between said notches (2) and said openings (6).

5. Walking sole according to claim 4, wherein said flexion groove (11) is cut in the lower surface of said bridge (7) of said relatively rigid material (A) extending between said notches (2) and said openings (6).

6. Walking sole according to claim 4, wherein said flexion groove (11) is cut in the upper surface of said bridge (7) of said relatively rigid material (A) extending between said notches (2) and said openings (6).

7. Walking sole according to claim 4, wherein said flexion groove (11) is parallel to said lateral edge (1*a*).

8. Walking sole according to any one of claims 1 to 3, wherein said filling elements (3, 8) lodged in said notches (2) and openings (6) respectively, are enclosed by junction lines (13, 14) recessed in said relatively rigid plastic material (A) enclosing them.

9. Walking sole according to any one of claims 1 to 3, wherein said filling elements (3, 8) lodged in said notches (2) and openings (6) respectively, are enclosed by junction lines (13, 14) recessed in the perimeter of said filling elements (3, 8).

10. Walking sole according to any one of claims 1 to 3, wherein said filling elements (3, 8) have upper sections, located above said notches (2) and openings (6) respectively, which are wider than their lower sections tightly inserted in said notches (2) and openings (6), thereby forming lateral projecting pieces (3*a*) covering at least partially the edges of said notches (2) and openings (6).

11. Walking sole according to any one of claims 1 to 3, wherein said filling elements (3, 8) lodged in said notches (2) and openings (6) respectively, are made of said same relatively elastic plastic material (B).

12. Walking sole according to claim 11, wherein said filling elements (3, 8) lodged in a notch (2) and an opening (6) respectively, are connected by means of a piece (9) made of duplicated molded plastic material (B) so as to form an "arch" above said bridge (7) in said relatively rigid plastic material (A) extending between said notch (2) and said opening (6).

13. Walking sole according to any one of claims 1 to 3, wherein said filling elements (3, 8) lodged in said notches (2) and openings (6) respectively, are made of different elastic materials.

14. Walking sole according to any one of claims 1 to 3, wherein the entirety of said walking sole composed of said main element made of said relatively rigid plastic material (A) and said filling elements (3, 8) made of said relatively elastic material (B) is covered with a layer of a filling material (C) which extends between the outer lateral edge of the sole (1*a*), made of said relatively elastic material (B), and the inner lateral edge (1*b*) of the sole, made of said relatively rigid material.

15. Walking sole according to any one of claims 1 to 3, wherein said layer of said relatively elastic plastic material (B) has a thickness corresponding to that of said complete sole (1), and said layer covers substantially the entire width of said sole.

16. Walking sole according to any one of claims 1 to 3, wherein said layer of said relatively elastic plastic material (B), having the same thickness as that of the entire sole, extends transversely over part of the sole, above said notches (2), said bridges (7) made of said relatively rigid material (A), and said openings (6), and wherein, beginning at the inner ends (6*b*) of said openings (6), the thickness of the entire sole is formed in its totality by said relatively rigid plastic material (A).

17. Walking sole according to any one of claims 1 to 3, wherein said elastic filling elements (3) lodged in said notches (2) are connected along the outer lateral edge of said sole (1) by a border (4) which is duplicate molded simultaneously with said individual elastic filling elements (3).

18. Walking sole according to any of claims 1 to 3, wherein each of said flexible tongues (5) carries at least one stud (12) designed to embed in the ground.

19. Sports shoe fitted with a walking sole according to any of claims 1 to 3.

* * * * *